United States Patent [19]

Le Clerco et al.

[11] Patent Number: 4,697,955

[45] Date of Patent: Oct. 6, 1987

[54] METHOD OF CONSTRUCTING REINFORCED CONCRETE WORKS SUCH AS UNDERGROUND GALLERIES, ROAD TUNNELS, ET CETERA; PRE-FABRICATED CONTRETE ELEMENTS FOR CONSTRUCTING SUCH WORKS

[76] Inventors: Pierre A. L. M. G. Le Clerco, Av.des Ormeaux 22, B 1180 Brusselles; Jean C. Delheusy, Av.deMalmaison 17, B 1410 Waterloo; Guy J. Rigot, Lambert Etienne 38, B-5300 Ciney, all of Belgium

[21] Appl. No.: 518,752

[22] Filed: Jul. 29, 1983

[30] Foreign Application Priority Data

| | | | |
|---|---|---|---|
| Jul. 30, 1982 | [BE] | Belgium | 0/208718 |
| Oct. 8, 1982 | [BE] | Belgium | 0/209205 |
| Mar. 4, 1983 | [BE] | Belgium | 0/210157 |

[51] Int. Cl.[4] ..... E21D 10/04

[52] U.S. Cl. ..... 405/135; 405/149

[58] Field of Search ..... 405/124, 126, 132, 134, 405/135, 136, 137, 149, 154, 155, 152, 157, 272, 274, 282, 283, 289, 267; 249/11, 1, 10, 12; 425/59; 138/105; 264/31, 32, 34, 35

[56] References Cited

U.S. PATENT DOCUMENTS

| | | | |
|---|---|---|---|
| 1,050,320 | 1/1913 | Williams | 405/134 |
| 1,441,698 | 1/1923 | Meem | 405/137 X |
| 1,671,679 | 5/1928 | Marston | 405/124 |
| 1,837,134 | 12/1931 | Porter et al. | 405/135 |
| 1,910,594 | 5/1933 | De La Mare | 264/34 |
| 2,959,197 | 11/1960 | Eggink et al. | 405/134 X |
| 3,111,811 | 11/1963 | Eggink et al. | 405/135 |
| 3,496,727 | 2/1970 | Weese et al. | 405/283 |
| 3,820,345 | 6/1974 | Brecht | 405/283 |
| 3,864,921 | 2/1975 | Marx et al. | 405/282 |
| 4,073,148 | 2/1978 | Zaretti | 405/149 |
| 4,116,011 | 9/1978 | Girault | 405/134 |
| 4,150,910 | 4/1979 | Maffei | 405/149 |
| 4,170,093 | 10/1979 | Cappellini et al. | 264/35 X |
| 4,314,775 | 2/1982 | Johnson | 405/155 |
| 4,459,063 | 10/1984 | Shaw | 405/124 |

FOREIGN PATENT DOCUMENTS

| | | | |
|---|---|---|---|
| 525387 | 5/1956 | Canada | 405/135 |
| 2715127 | 10/1978 | Fed. Rep. of Germany | 405/157 |
| 2949277 | 1/1981 | Fed. Rep. of Germany | 405/135 |
| 2472074 | 6/1981 | France | 405/282 |

OTHER PUBLICATIONS

"Precast Units Make a Culvert", Engineering News Record, May 28, 1964, p. 42.

*Primary Examiner*—Cornelius J. Husar
*Assistant Examiner*—Nancy J. Stodola

[57] ABSTRACT

In a method of constructing a reinforced concrete work such as a road tunnel, an underground gallery or a tunnel for an underground railway, there is first excavated an open trench 62 in which there are then placed, consecutively and contiguously, prefabricated hollow concrete frame element 4, the external faces of which have reinforcements 5. A filler concrete 18 is then poured so as to cover the joints between elements and to cooperate with the reinforced concrete of the frame elements and with the reinforcements so as to construct, by consecutive stages and rapidly, a monolithic work. The strength of this monolithic work is appreciably greater than the respective strengths of the prefabricated elements initially placed and of the filler concrete. Finally the trench is filled. Preferably the external reinforcements 5 of the frame elements are such as to cooperate with the filler concrete which is subsequently placed round the elements.

8 Claims, 15 Drawing Figures

FIG.3
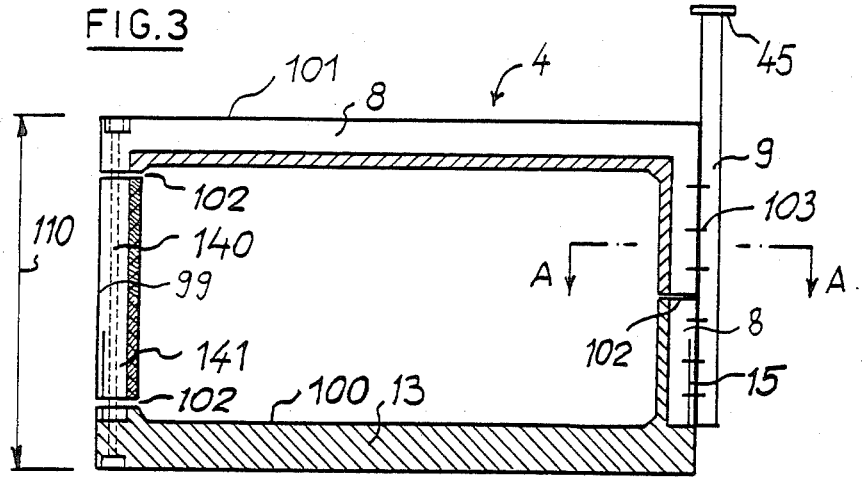
FIG.4
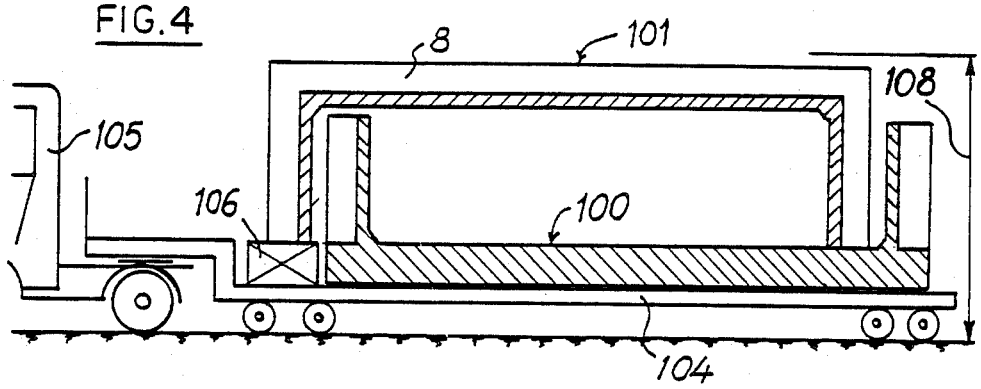
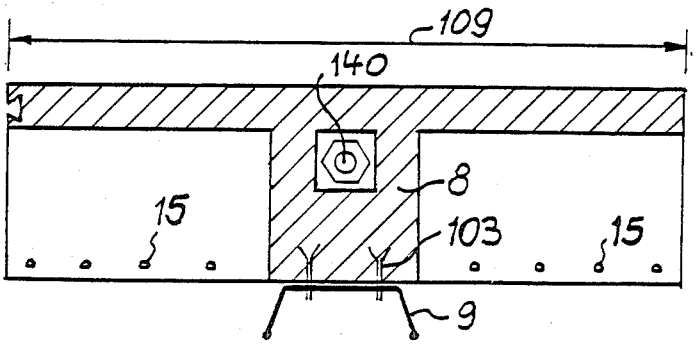
FIG.5

FIG. 7
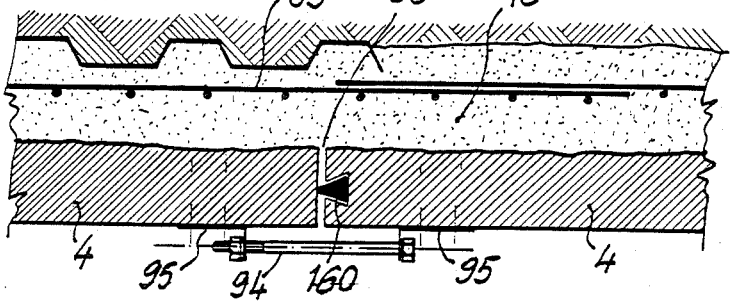
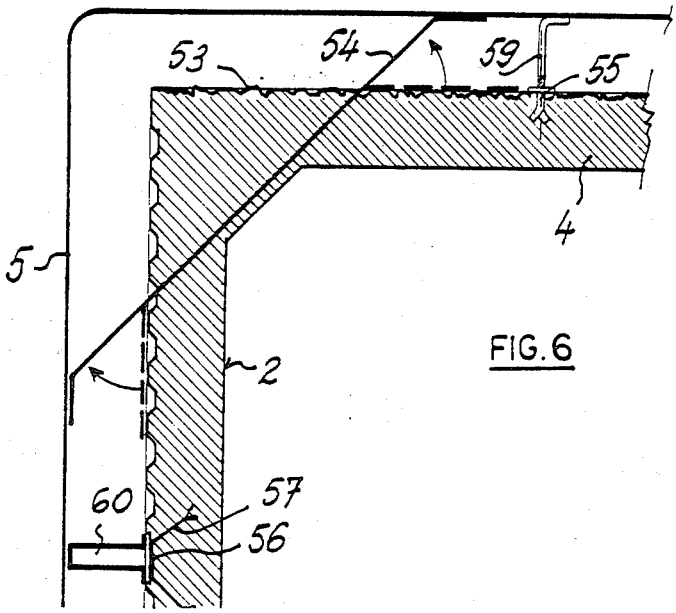
FIG. 6
FIG. 8
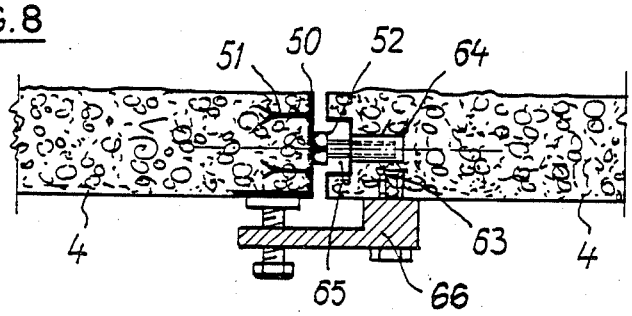

METHOD OF CONSTRUCTING REINFORCED CONCRETE WORKS SUCH AS UNDERGROUND GALLERIES, ROAD TUNNELS, ET CETERA; PRE-FABRICATED CONTRETE ELEMENTS FOR CONSTRUCTING SUCH WORKS

BACKGROUND OF THE INVENTION

The present invention relates to the construction of reinforced concrete works, such as underground galleries, road tunnels, tunnels for underground railways, et cetera, employing prefabricated elements.

The construction of these works using prefabricated elements gives rise to a difficulty, because, in general, on the one hand, the weight of the elements is considerable, and on the other hand, the bulk of these elements renders their transport by road convoy difficult if not impossible.

It is a first aim of the present invention to overcome this difficulty, to lighten these prefabricated elements as much as possible and to reduce their external dimensions while retaining an internal finish as close as possible to the final finish, and thus to permit the performance of the method under particularly economical conditions.

A second aim of the invention is to achieve a continuity of the work by a second stage concreting executed on site astride the joints between the prefabricated elements. This continuity is fundamental, both from the standpoint of the mechanical strength and of the differential subsidences caused by traffic and from the standpoint of fluid-tightness. In order to achieve these aims, the method which is the subject of the invention is substantially characterized in that an open trench is first excavated, that hollow prefabricated concrete elements are then placed therein, consecutively and contiguously, each consisting of a frame, the external faces of which comprise reinforcements, that a filler concrete is poured covering the joints between elements and cooperating with the reinforced concrete of the elements and with the reinforcements so as to construct, in consecutive stages and rapidly, a monolithic work, the strength of which is appreciably greater than the respective strength of the prefabricated elements intially placed and of the filler concrete; and that a filling is finally executed.

In the performance of the method, the external reinforcements are fixed to the prefabricated element ("preframe") before the prefabricated element is placed.

An essential feature of the invention is the prefabricated reinforced concrete element itself, called "preframe", comprising the above-described characteristics.

In the case of a tunnel of prefabricated elements of very large dimensions, the preframes exhibit sizes which exceed the official road transport height limits.

In this case, the preframes are constructed in two or more complementary elements, which will be assembled on site afterwards.

The installation of the elements is effected either in an open trench excavated dry, or in consecutive transverse trenches excavated in thixotropic mud, particularly when the work has to be constructed on a dense urban site in streets or main roads near existing buildings.

BRIEF DESCRIPTION OF THE DRAWING

These prefabricated elements, and the embodiments of the method, dry and in thixotropic mud, will now be described in greater detail with reference to the accompanying drawings, in which:

FIGS. 3, 4, and 5 relate to preframes constructed of two or more complementary elements;

FIGS. 6, 7, and 8 are construction and assembly details of the preframes;

FIG. 11 is a horizonatl view of the installation site near buildings;

FIG. 12 shows vertical cross-section illustrating the essential characteristics of the installation method;

FIG. 13 shows a vertical longitudinal section relating to the same method during the installation of a preframe element.

FIG. 14 shows another vertical section relating to this same method during the excavation of a fresh traverse trench against the prefabricated element just placed.

FIG. 15 shows a horizontal section through the vertical side walls of two adjacent elements.

Figure 1:
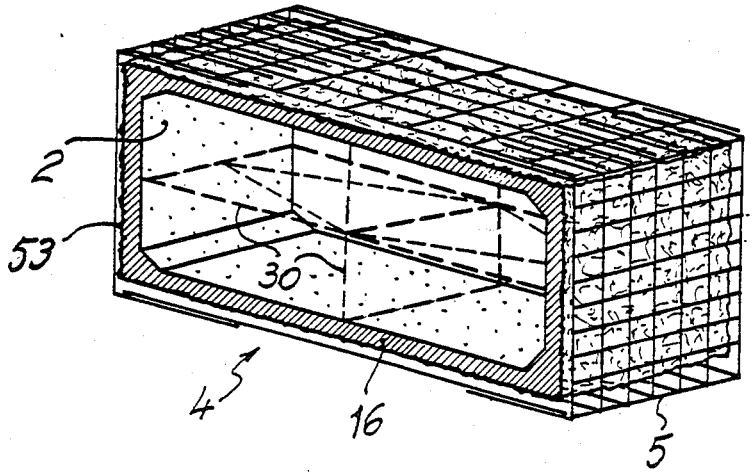
FIGS. 1, 2 are perspective views showing different embodiments of the so-called preframe element.
Figure 2:
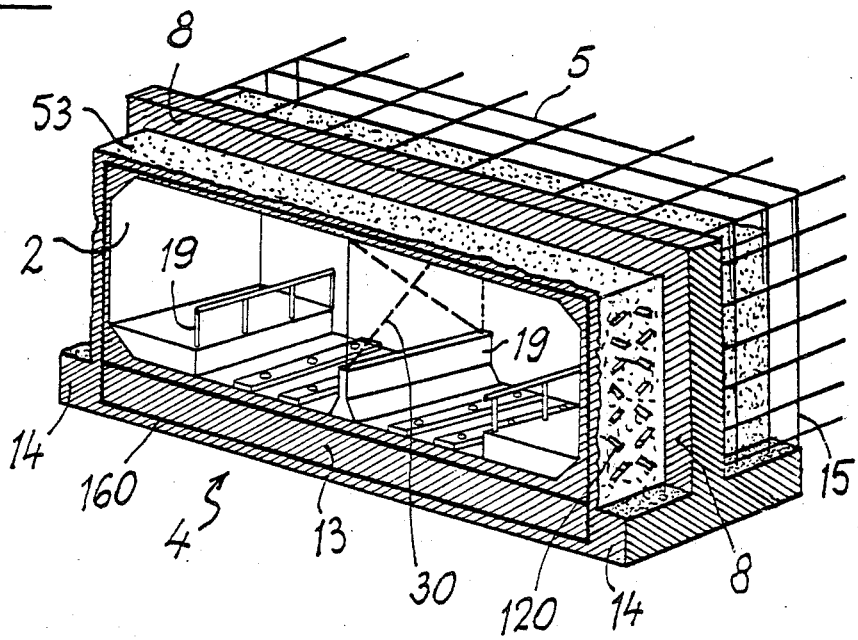

DETAILED DESCRIPTION OF PREFERRED EMBODIMENTS (A) Description of the Preframe As illustrated FIGS. 1 and 2, the preframe element is a hollow block 4 produced with reinforced concrete bottom, side and upper walls as thin as possible, that is to say in practice from 5 to 15 cm thick. The floor or bottom wall is designated 16.

The internal face 2 of the preframe 4 is generally cast smooth round a mould, presenting an appearance as close as possible to the required finished appearance.

On the other hand, the external face is produced either in rough concrete 53 without external shuttering, or with a shuttering comprising irregularities or indentations 120 with the effect of creating by moulding a surface comprising asperities (as best seen in FIG. 2).

FIG. 2 shows another embodiment of a preframe 4 comprising internal finishing elements 19, specifically platform elements for an underground railway station, the safety handrails and the finishing coverings on the floors, walls and ceilings.

The preframe illustrated in FIG. 2 comprising a stiffening rib 8, the thickness of which corresponds to the total and final thickness of the walls after production of the filler or added concrete. This rib 8 is essential in the case of installation in thixotropic mud, as shown later on by referring to the method.

The ribs 8 extend towards the exterior and in the center of the two vertical walls, and on the roof of the element.

These reinforced concrete ribs 8 are either prefabricated in the factory at the same time as the preframe 4, or else constructed on site at the same time as an apron or raft complement 206, to be described hereinafter if appropriate, particularly if the official road transport size limit does not premit their prefabrication at the factory. The preframe illustrated in FIG. 2 further comprises an apron or raft 13.

Since these elements are intended to be placed on the levelled ground 61, on the surface of the ground or in a trench 62 (FIG. 9), the apron 13 of the preframe may be produced in its final thickness, whereas the other walls are produced with a small thickness as explained above.

The apron 13 comprises excrescences or wings 14 on the exterior of the vertical walls with vertical reinforcements 15 anchored in these same excrescences or wings.

Figure 10:
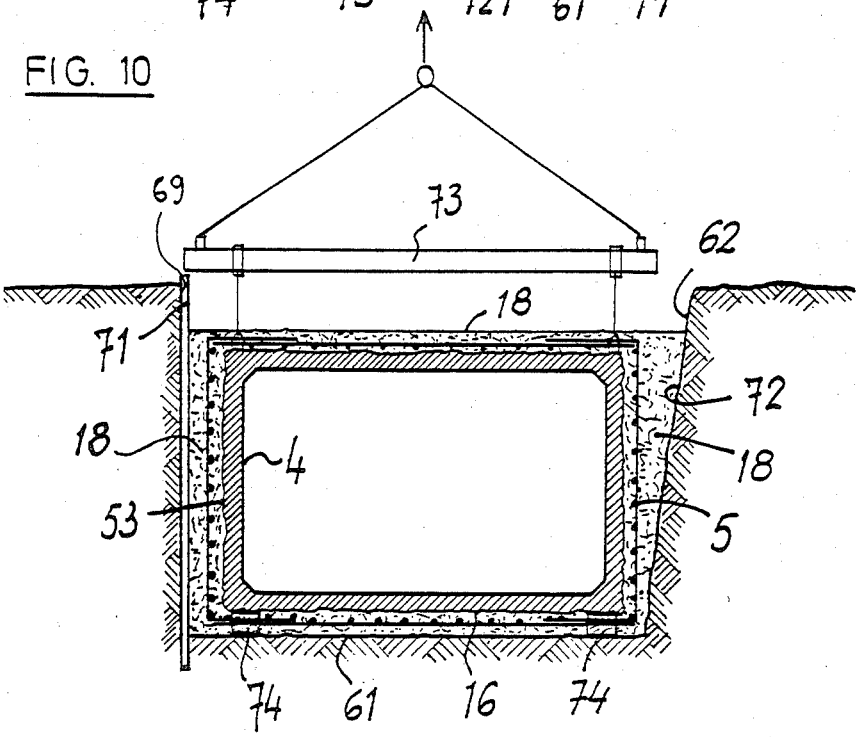

As shown in FIG. 10, this makes it possible to avoid subsequent concreting between the lower horizontal part or bottom 16 of the preframe and the ground level 61, concreting which may possibly be made rather difficult if the complementary thickness to be concreted is small.

On the other hand, a preframe 4 constructed as shown in FIG. 2 will be heavier and will be bulkier than a similar element according to FIG. 1.

Ultimately, it is considerations of weight, facility of concreting and installation which will guide the choice between the two types of "preframes".

Where the span of the roof or the vertical side walls of the preframe becomes too great to be crossed by a slab 5 to 15 cm thick for example, vertical or horizontal temporary stays 30 may be provided to reduce this span (FIGS. 1–2–9–12).

These stays 30 will be maintained in position during the production of the external filler concrete 18 (FIG. 6) and will be removed only after this same concrete has set and has attained sufficient strength.

In the case of a tunnel to be constructed with large-dimension preframes, the official road transport height limits are generally exceeded.

In this case, the preframes comprise two or more complementary partial elements 99, 100 and 101 (FIG. 3) which will subsequently be assembled on site. In the case of two complementary partial elements 100 and 101, they nest mutually, thus reducing their height 108 during transport (FIG. 4). The joint 102 between two half-preframes is located approximately at mid-height of each vertical side wall. The advantage of such a joint position lies in the fact that the ultimate moments which will stress the tunnel in its final stage generate tractions on the exterior of the filler concrete, and therefore in the complementary reinforcements which are added round the preframe.

The right hand part of FIG. 3 shows a preframe 4 consisting of two half-preframes 100 and 101. The height 110 of this preframe exceeds the official road transport limit. The lower half-preframe 100 may comprise a prefabricated apron 13, as previously explained (FIG. 2).

The two half-preframes 100 and 101 also comprise a stiffening rib 8 at mid-width.

FIG. 4 shows a low-load trailer 104 towed by a tractor 105. The half-preframe 101 is placed on the trailer astride the half-preframe 100, chocks 106 being interposed.

The height dimension on the low-load trailer thus remains below the official height limit 108 for road transport.

FIG. 5 shows a horizontal section AA through the upper half-preframe illustrated in FIG. 3. The width 109 of the preframe is likewise smaller than the official road transport limit. The assembly of the two half-preframes 100 and 101 on site may likewise be effected by a steel rod 140 comprising a nut at each end, which is placed in a tubular housing 141 left in the ribs 8 of the vertical side walls (FIG. 3).

After assembly on site, it is only necessary to tighten the bolts with a dynamometer wrench to effect a vertical post-stressing in the vertical side walls. This post-stressing may be calculated to prevent the joints 102 inside the preframe from opening by the effect of the lateral thrusts upon the vertical side walls due to the ground, to water and to the overloads above the tunnel.

An injection of cement grout may optionally be provided in the joint 102 to produce fluid-tightness on the one hand and the continuity of the concrete on the other hand to take up the compressive forces resulting from the external stresses. In calculating the dimensioning of the total thickness of concrete in the vertical walls, in the roof and in the apron of the preframe 4 with its filler concrete, values will preferably be chose such that the stresses do not generate traction forces upon the internal face of the side wall at the position of the joint 102 between the two half-preframes 100 and 101. This will make is possible to avoid the need to apply a post-stressing as explained above.

In the case where the preframe consists of more than two partial elements, the above-stated principles of assembly are likewise applied. (See the left hand part of FIG. 3).

The external face of the preframe also comprises (FIG. 6) temporary reinforcements 54 and/or anchorage sockets 55 with screwthreaded rods 59 and/or metal plates 56 with dogs 57 and staples 60 which permits, after the concrete has set and the prefabricated concrete has been deshuttered, the placing of peripheral reinforcements 5 which will be attached to the temporary reinforcements 54, to the screwthreaded rods 59 or to the staples 60.

This last operation is executed in the prefabrication factory or on site, before the installation of the elements.

(B) Description of the Assembly of Preframes

In order to achieve fluid-tightness if required and continuity between the elements, it is provided according to the invention to execute the second stage concreting 18 astride the joint 88 between two preframes with an overlap reinforcement 89 as shown in FIG. 7.

The fluid-tightness possibly required between these elements is achieved by peripheral joints 160 of compressible material placed between the preframes (FIGS. 2 and 7). Generally speaking, this type of compressible joint withstands the lateral water pressure only if the joint is compressed along the longitudinal axis of the tunnel. Before the second stage concreting 18, the assembly and the compression in the joint between the juxtaposed elements is then effected by bolts 94 connecting metal angle pieces 95 anchored in each of the juxtaposed elements generally inside the latter (FIG. 7). After the concrete 18 has set, the bolts 94 and the angle pieces 95 can be dismantled and recovered for the assembly of other preframes.

FIG. 8 shows a device for adjusting the preframes when being placed on site. They will be described later on in connection with the preframe assembly method.

(C) Method of Positioning in a Trench Excavated Dry

Figure 9:
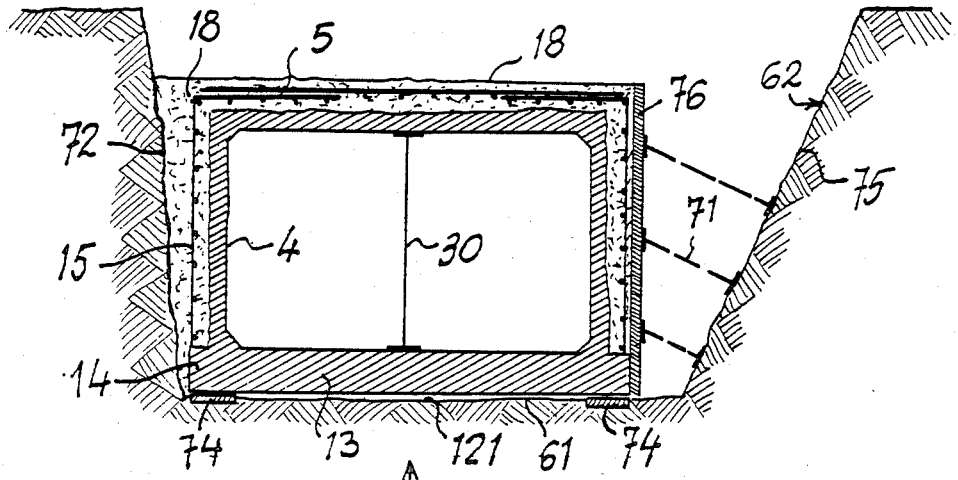
FIGS. 9 and 10 are views illustrating the placing of the elements in a trench excavated dry.

FIGS. 9 and 10 refer to the placement and assembling of preframes in a trench excavated dry.

FIG. 9 shows a preframe 4 according to FIG. 2 placed at the bottom of a trench 62 comprising a fairly steep bank 72 and another bank 75 with a gentle slope.

Where the bank 72 is steep, or even vertical (69, FIG. 10), the second stage concrete 18 will be installed between this bank and the preframe 4.

On the side of the gently sloping bank 75, to avoid installing excessive quantities of concrete, a vertical shuttering 76 (FIG. 9) is placed with optional supports 71 on the bank. This shuttering 76 may likewise be bolted into the ribs 8 (FIG. 2) when they are provided. This shuttering 76 is recoverable after the concrete has set. It may likewise be replaced by a non-recoverable shuttering of profiled sheet steel for example.

FIG. 10 shows how a preframe provided with peripheral reinforcements can be installed in a trench 62 excavated dry, comprising a vertical wall 69 armoured by sheet piles 71 for example, and another wall 72 with a fairly steep bank taking into consideration the cohesion of the ground.

In such an operation, using a crane with a beam 73, the preframe 4 is installed in the bottom 61 of the trench 62. It is adjusted on four jacks 74 placed on the bottom of the trench, which permit the preframe to be positioned with the required degree of accuracy.

As soon as the preframe is correctly adjusted, timber, concrete or steel chocks are placed and wedged between the preframe and the foundation level on the ground, thus permitting the adjusting jacks to be removed and recovered. Fluid-tightness between adjacent preframes if provided as described above in connection with FIG. 7.

The second stage concreting 18 is then performed, embedding the chocking and reinforcement elements in the concrete mass.

The temporary jack 74 may be replaced by non-recoverable bag jacks, which are injected with a cement grout to effect the correct adjustment of the preframe; these jacks no longer require chocking devices and are embedded in the concrete mass cast on side on the outside of the preframe.

The temporary jacks 74 may likewise be replaced by small prefabricated concrete slabs 74 which are adjusted to the required level beforehand.

If the apron 13 is prefabricated (FIG. 9), the space 121 between the small slabs 74 is brought flush with the laying level by fresh stabilized sand at the time of laying, or filled afterwards by a highly fluid lean concrete.

According to FIG. 10, the second stage or filler concrete 18 is poured beneath the preframe, on both sides of the latter and above the latter.

The filler concrete is a conventional concrete consisting of sand, gravel, cement and water, but is may also comprise traction-resistant fibres of steel, glass, asbestos or other material.

(D) Method Using Thixotropic Mud

Where the underground gallery is required to be constructed in an urban site, in streets or main roads for example, and therefore near existing buildings, it is not generally possible to excavate a trench with a bank, since the width of the main road does not permit this.

It is rarely possible to excavate a trench armoured with sheet piles, for example, because the driving of these sheet piles constitutes a nuisance for the population residing in this district. On the other hand, this driving generally causes considerable and inadmissible subsidences of the buildings in the immediate vicinity of the treanch excavated.

The technique currently known is to excavate armoured trenches or longitudinal concrete walls moulded in the ground in thixotropic mud. These two techniques necessitate the consecutive construction of the walls, then of the roof and of the apron which connect the longitudinal walls. The execution of such works is protracted and therefore interferes considerably with the local population for a long period, which is difficult for them to accept.

The present invention proposes an original method of rapid installation of prefabricated elements of the future gallery without causing the above-mentioned disadvantages.

The method is substantially characterized in that consecutive trenches, which are substantially rectangular and contiguous, are excavated with their longest dimension extending traversely relative to the longitudinal axis of the future tunnel, thixotropic mud is poured into each trench, at least one preframe such as defined in FIG. 2 is lowered into each trench consecutively, positioning it so that it is juxtaposed with the gallery element previously produced; the exterior, between the ribs of the two half-preframes, is then concreted, and the remaining space of the trench is filled with a filling material such as gravel, sand or soil.

A description of this will be given by way of example, not implying a limitation, with reference to FIGS. 11 to 15.

One particular advantage is that the proposed technique permits the levelling of the longitudinal walls to be eliminated.

From the initial ground level 211, a reinforced concrete guide wall 201 is first constructed to a depth of approximately one to two meters on each side of the trench to be excavated. This guide wall is generally complemented by a reinforced concrete slab 202 intended to act as a travelling track for a gantry 203 which will be installed subsequently. If necessary, this guide wall 201 will incorporate a duct 235 (FIG. 12) for the urban service pipes.

Figure 11:
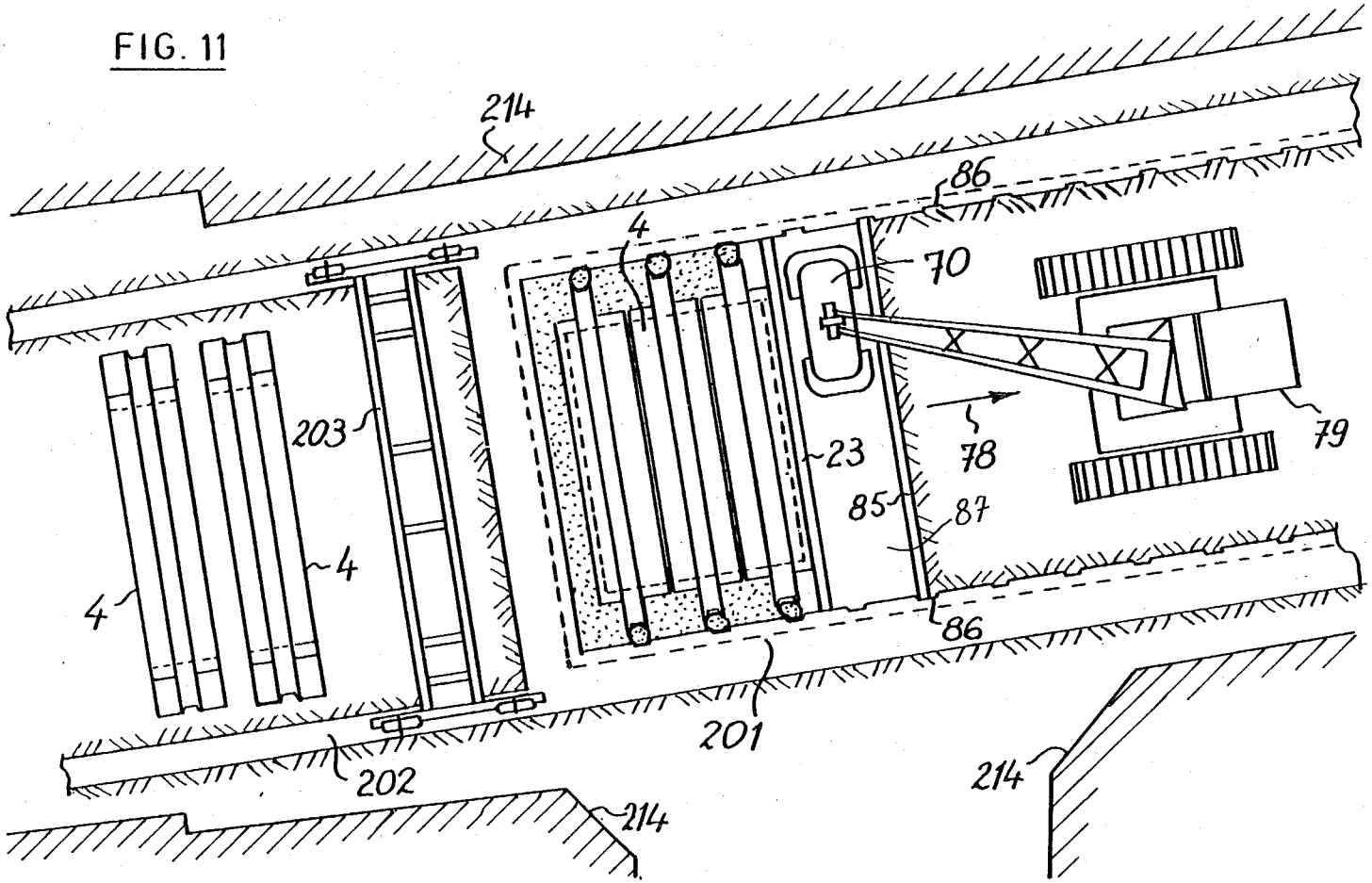
FIGS. 11 to 15 relate to the installation of the prefabricated elements in a trench excavated in thixotropic mud.

As illustrated in FIG. 11, the site will progress in the direction of the arrow 78.

The preframes 4 have been prefabricated in the factory as stated above. They preferably have a stiffening rib as shown in FIG. 2. They are then transported to the installation site, where they are stored in sufficient number (FIG. 11).

Figure 13:
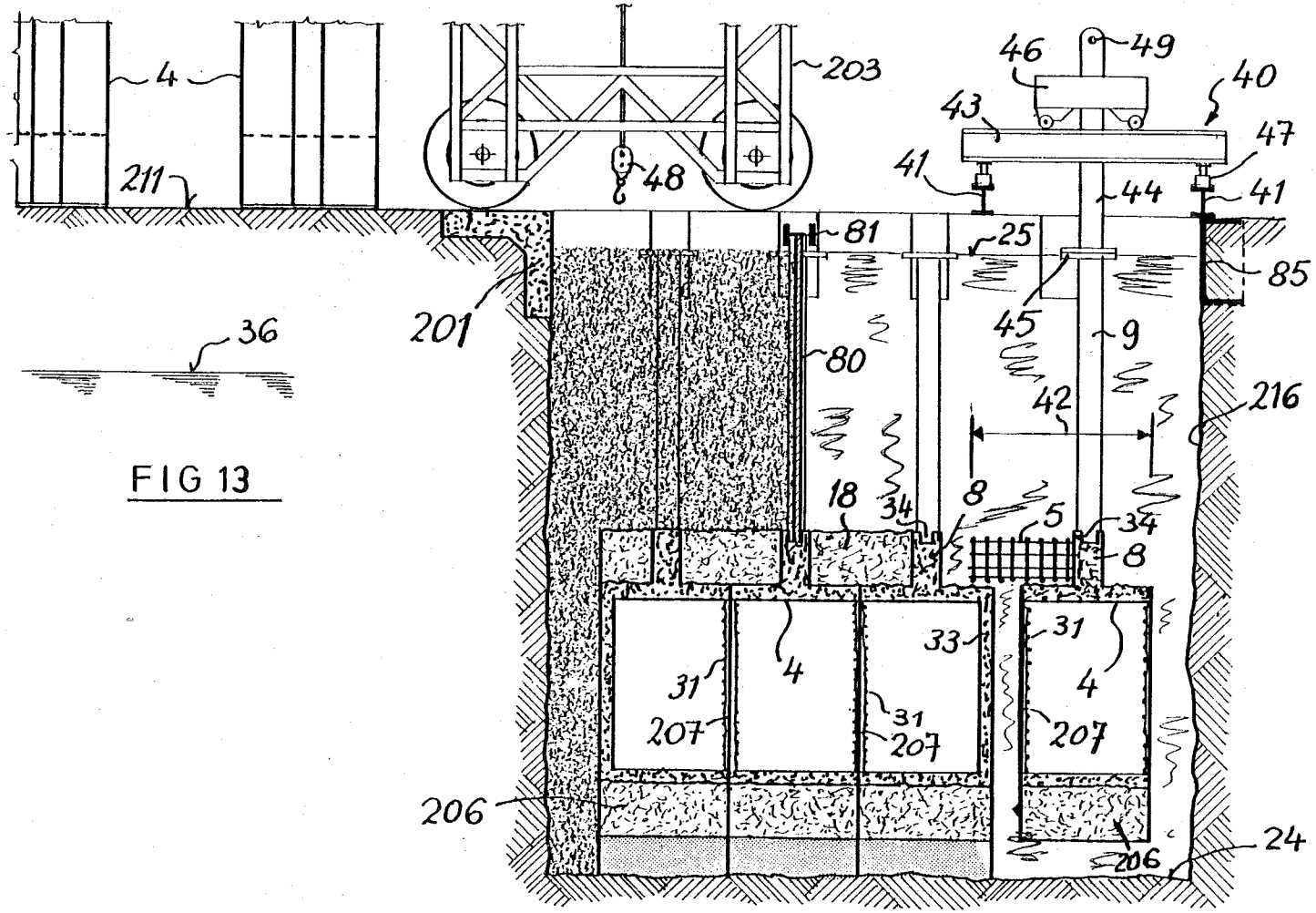

As stated above, peripheral or complementary reinforcements 5 are attached to this preframe in the factory or on site. These reinforcements 5 are arranged on the upstream side of the preframe 4 relative to the rib 8 so as to overlap an upstream preframe element already placed up to the rib of said upstream element (FIG. 13).

These complementary reinforcements 5 will therefore cover the joints between the elements 4 installed, thus achieving continuity of the future gallery after the complementary of second phase concreting.

The thickness of the apron or raft is optionally increased by a filler concrete incorporating the complementary reinforcements 5, thus constructing an apron complement 206 of reinforced concrete poured on site.

The apron 13 (FIG. 2) may likewise be entirely prefabricated in the factory as previously explained.

To reduce the consumption of bentonite and to avoid the subsequent cleaning of the interior of the gallery, the preframes 4 also comprise to flexible closure walls 207 attached to the upstream and downstream periphery of the preframe. These walls 207 consist of a material substantially permeable to water but impermeable to substances in suspension in water. A non-woven polyester material may be used, for example. This flexible walls 207 may be maintained in position between two sufficiently rigid metal lattices 31 which are attached to the periphery of the preframe 4 and to the temporary stays 30, if appropriate, and/or comprise high tensile internal fibre reinforcements.

Some preframe elements 32 also comprise an impermeable rigid wall 33 generally made of concrete. This will permit a section of a plurality of elements 4 to be isolated subsequently upstream of another element 32.

Figure 15:
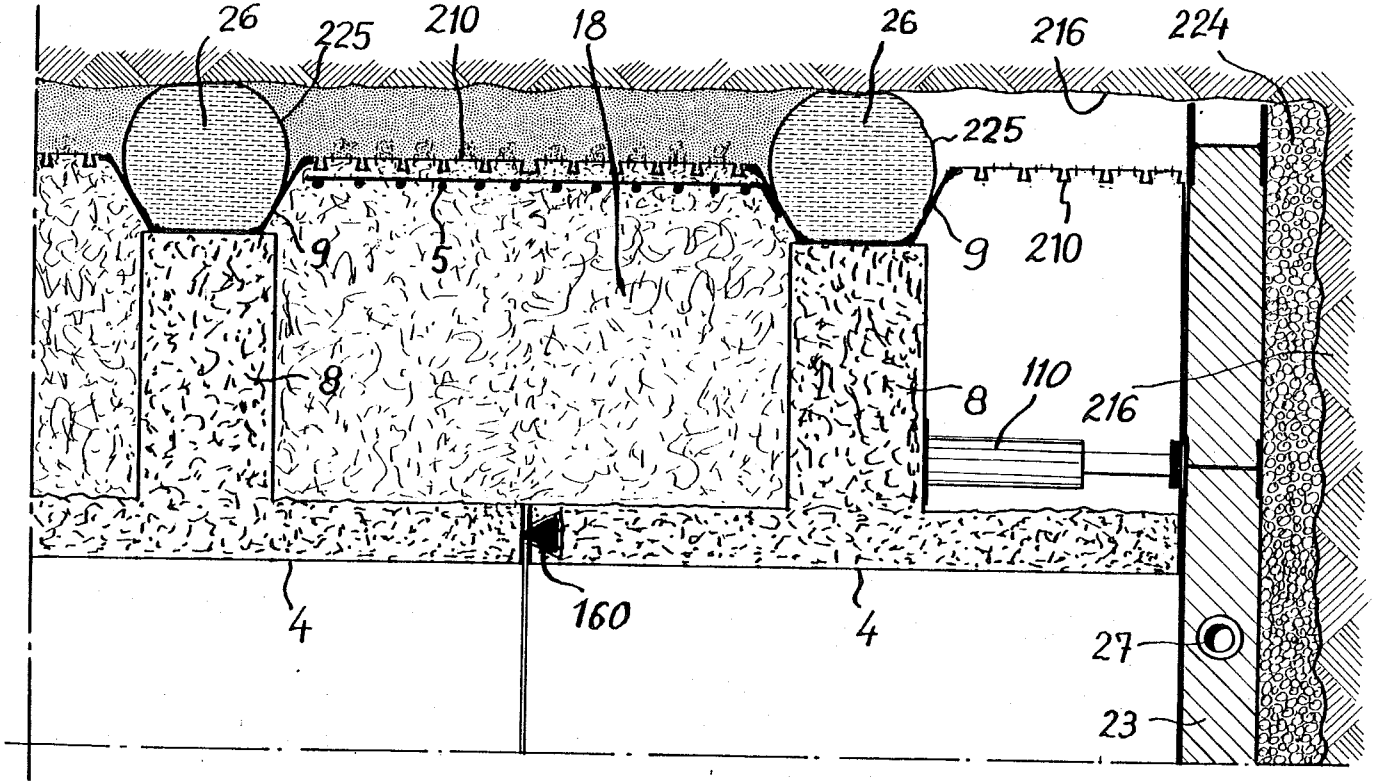

The ribs 8 permit the lateral attachment of rigid steel hangers 9 consisting either of a metal beam, or preferably of a U shaped steel element intended to be used as steel foundation piles. Each hanger 9 has an end provided with an assembly plate 45 for a purpose described hereafter. Inside the U of the hanger, a tubular element 225 of flexible and permeable cloth is fixed along the total length. This "sausage" 225 is blocked at its lower part and is intended to be filled with concrete as shown in FIG. 15.

Figure 14:
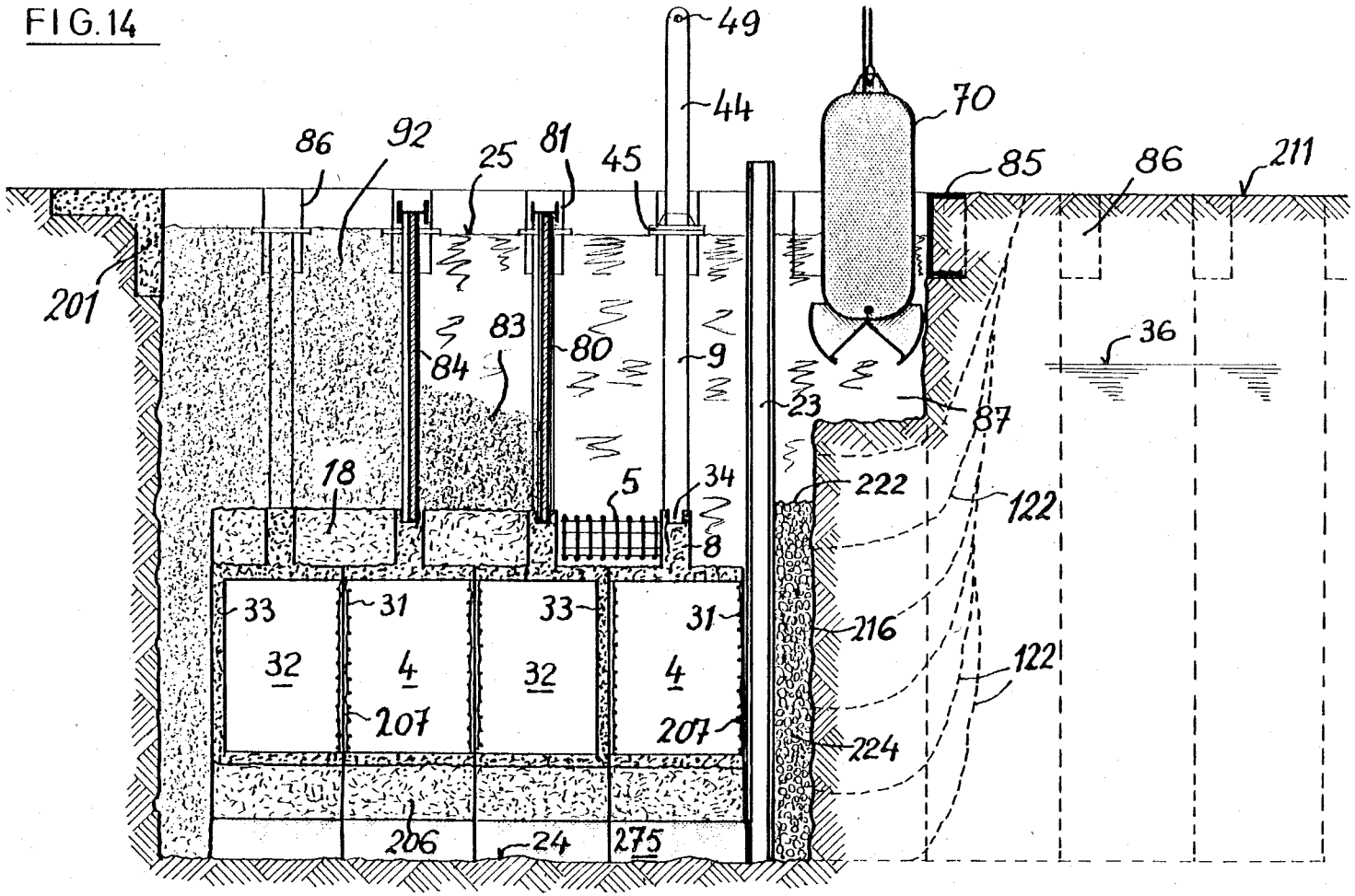

The hangers 9 are attached to the preframe and have sufficient length to be able to be hooked to and suspended from the installation gantry 203 by cooperation of the gantry hooks 48 with hanger extension origifice 49. When large-dimension preframes are cited as shown in FIGS. 3-5, the hanger 9 with its assembly plate 45 can create a connection between a half-preframe 100 and a half-preframe 101 through the intermediary of a series of anchorage slabs or anchorage bolts 103 (FIGS. 3 and 5). As shown in FIGS. 13 and 14, the ribs 8 of the roof of each preframe 4 comprise rectangular notches which will permit the base of a coffer-dam 80, to be discussed below, to be placed therein. Metal sheets 210 (FIGS. 12 and 15) perforated with small-diameter circular holes, are attached to the reinforcements 5 with spacing devices to form the future non-recoverable shuttering wall of the vertical side wall of the tunnel to be constructed, thus avoiding the pollution of the filler concrete by possible caving in of earth. This sheet 210 may optionally be profiled and cooperative. These sheets 210 have sufficient length to reach at least the top level 22 of the elements 4 installed. The preframes thus prepared are ready to be installed in the trench excavated in thixotropic mud.

An important characteristic of the invention is that this trench in thixotropic mud is excavated by transverse sections 81 (FIG. 11) at right angles to the axis of the tunnel to be constructed, by means of a crane 79 equipped with a hydraulic clutch or with a special hopper 70 such as those used for the construction of moulded concrete walls in the ground in thixotropic mud.

In the present method, this hopper 70 will generally have considerably larger dimensions than those of the hoppers currently used, this being due to the size of each consecutive trench.

The trench may likewise be excavated by means of an excavator working backwards, in the consecutive passes 122 (FIG. 14).

In case the special hopper 70 is used, a detachable transverse guide wall 85, generally of steel, is placed in notches 86 provided in the guide walls 201.

In fact, the trenches or cuts have a width corresponding to the distance between two guide walls 201 parallel to the longitudinal axis of the future tunnel. In practice, this width will vary from approximately five to fifteen meters.

On the other hand, the length of these consecutive trenches along the axis of the future tunnel to be constructed will be fairly short. In practice, this length will be approximately two to three meters. This short length should permit the transverse trench to be excavated with no risk of subsidence for the adjacent buildings 214, the foundations 215 of which may be extremely close to the trench thus excavated (FIGS. 11 and 12).

To prevent this subsidence and the danger of the ground 215 in situ collapsing, the trench is permanently filled with thixotropic mud, generally consisting of bentonite mud, namely up to the level 25, which is higher than the ground water level 36.

Figure 12:
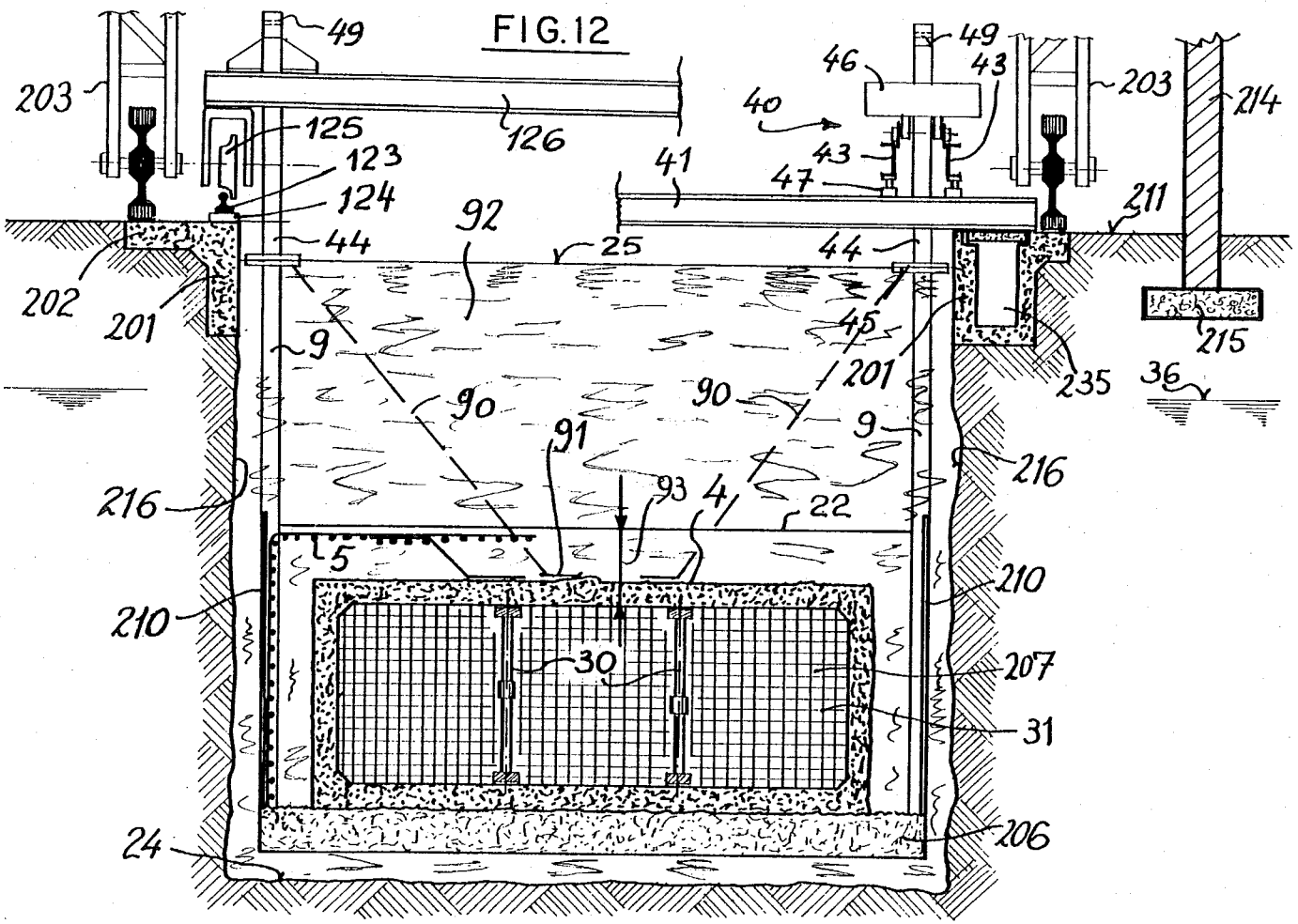

A positioning and adjusting chassis 40 is then placed over the trench excavated in thixotropic mud and resting upon the guide walls 201 (FIGS. 12 and 13).

This chassis 40, generally made of steel, substantially comprises two girders 41 mutually spaced at a horizontal distance greater than the distance between the longitudinal bulk 42 of the preframe 4 and the reinforcements.

Double crosmembers 43 are provided so as to frame an extension 44 bolted to the hanger 9 through the intermediary of connecting plates 45 respectively welded to the top of the hanger 9 and to the bottom of the extension 44.

A carriage 46 or a horizontal positioning device can move horizontally on the double crossmembers 43 after the preframe 4, suspended by two hangers 9 on each side of the trench, has been placed.

Jacks 47 permit the accurate height adjustment of the preframe 4 to be effected in accordance with the instructions to be given by a surveyor before or during the installation of each element 4.

The chassis 40 may be replaced by a carriage 126 (FIG. 12) comprising at least four steel wheels 125 of the railway or grooved type which travel on two longitudinal rails 123 resting upon the guide walls 201.

These rails 123 are adjusted laterally and vertically to accurate positions as instructed by the surveyor, by placing chocks 124 beneath the rails so that the preframe 4 (FIG. 13) being placed comes to be positioned accurately and in the correct position against the preframe 32 previously placed.

A transverse trench being completed to the bottom level 24 and the positioning chassis 40 or carriage 126 being prepared, a preframe 4 with all its equipment already described is lifted by the gantry 203 and brought above the trench, which is still full of thixotropic mud.

The preframe 4 is lowered until it penetrates partly into the thixotropic mud.

In order to balance the instantaneous pressure between the mud and the flexible and permeable wall 207 of the preframe 4, the latter is partly filled with water. The lowering of the preframe 4 can then be continued down to a fresh depth below the height of the preframe 4, which is once more filled with water to balance the instantaneous pressure on each side of the flexible and permeable wall 207. This procedure is continued until the preframe 4 is totally filled with water. The preframe 4 can then be lowered down to the specified level, but at a certain horizontal distance from the element 32 already placed upstream (FIG. 13).

The two hangers 9 equipped with their respective extensions 44 are then supported by the positioning carriage 126 or chassis 40.

The two hooks 48 of the gantry 203 can then be disconnected from the suspension orifices 49 of the two extensions 44.

If necessary, the preframe 4 is also adjusted in height by the jacks 47, then moved horizontally toward the element 4, already placed, by means of the positioning carriage 126 or device 46. This precise operation is carried out in accordance with a surveyor's instructions.

The juxtaposition of the new preframe 4 against the element 4 already installed involves an accurate and predetermined horizontal adjustment to enable the production and installation tolerances of the preframes 4 to be corrected.

FIG. 8 shows the device generally provided for this adjustment at three points of the preframe 4 installed.

The preframe 4 already installed comprises this device on its edge, at three points, generally in the center of the apron and at the two top angles between the rood and the vertical walls of the element. This device consists of a small steel plate 50 firmly anchored in the concrete by dogs 51 or other anchorage devices. At the same corresponding positions of the edge of the new preframe 4 to be placed, this device consists of an adjusting screw 52 which can rotate in a screw-threaded socket 63 fixed to dogs or other anchorage device 64.

A similar device 66 permits the accurate vertical adjustment and the taking up of the negative pressure due to the filling beneath the apron.

A generally cylindrical cup 65 is provided to house totally the head of the screw 52 when it is screwed to its extreme. The three adjusting screws 52 of each new preframe 4 installed are adjusted as instructed by the surveyor as a function of the actual position of the element 4 immediately adjacent upstream.

The new preframe 4 being thus correctly adjusted on the bottom (FIG. 14) of the trench against the previous element 4, a vertical coffer-dam 23 constructed of sheet piles or of girders with prefabricated concrete panels, or by any other system, is then installed downstream of the preframe 4 which has just been installed and against the latter (FIGS. 14 and 15). This coffer-dam 23 has a height which extends from the bottom 24 of the trench to slightly above the natural level 211 of the ground, and in any case above the level 25 of the bentonite mud.

The space between the coffer-dam 23 and the vertical wall of the ground 216 is then filled with gravel 224 immersed in the bentonite mud. This filling with gravel is effected up to at least the level 22 corresponding to the top level of the element 4 placed.

This gravel 224 exerts a powerful horizontal thrust upon the coffer-dam 23 and upon the element 4 which has just been placed, thus pressing it firmly against the previous element 4 upstream (FIG. 14) and crushing the fluid-tight joint 160 of compressible material (FIG. 7).

In practice, however, it is difficult to evaluate correctly the value of this horizontal thrust of the gravel, whereas the join 160 must be compressed accurately to be effective.

The coffer-dam 23 (FIG. 14) will generally comprise jacks 110 (FIG. 15) which will permit a constant, accurate and adequate horizontal force to be exerted to crush the joint 160 correctly.

The "sausage" 225 is then filled with concrete 26 so as to block the space between the hangers 9 and the ground 216 (FIG. 15).

A material 275, such as fluid lean concrete, is then poured beneath the apron 206 of the element 4 (FIG. 14). This material 275 is poured under the thixotropic mud through the intermediary of concreting tubes 27 which may optionally be housed in the thickness of the coffer-dam 23 (FIG. 15).

Immediately after this material 275 has set, concrete 18 is poured through a concreting tube between the vertical walls of the two contiguous preframes 4 and the sheets 210 of the non-recoverable perforated shuttering. Progressively as this fresh concrete rises, it overflows partly through the holes in the shuttering, thus filling the space between the ground 216, the non-recoverable shuttering 210 formed by the steel sheets, and the "sausage" 225 filled with concrete 26. The concrete 18 incorporates the reinforcements 5 attached to the elements 4.

This concreting is continued to pour the concrete 18 (FIGS. 13 and 14) covering the roofs of the two contiguous preframes 4.

A second coffer-dam 80 comprising a girder 81 at its summit is placed in the notch 34 located in the shoulder 8 of the element 4 previously placed.

Gravel 83 (FIG. 14) is then deposited upstream of this coffer-dam 80, while progressively removing an identical coffer-dam 84 which was placed above the antepenultimate element.

The cycle of operations can be recommenced at this point.

The hopper 70 excavates the next trench 87 in thixotropic mud between the coffer-dam 23 and a removable guide wall 85. This hopper will discharge the gravel 224 at the same time as the earth 216 in situ. The cycle of operations is then resumed as previously described.

The same would apply if the special hopper 70 were replaced by a hydraulic grab or a backacter, but in these cases the removable guide wall 85 is not used.

FIG. 12 likewise shows a novel device acting in the case of large-span preframe elements 4.

Oblique metal hangers 90 are attached to metal plates 91 anchored in the roof of the preframe 4.

This device makes is possible to reduce considerably the thickness 93 of the concrete and the corresponding reinforcements of the roof of the preframe element 4, by creating intermediate supports which reduce the span.

These oblique hangers 90 may be either attached to the two vertical hangers 9 by means of assembly plates 45, or anchored in the future filling.

The upper part of the trench may be filled with gravel injected with concrete, or with lean concrete 92 which entirely embeds the metallic hangers 9 and 90.

FIGS. 1, 2, 9, 10 and 12 show preframes of rectangular shape. It is however to be understood that these preframes may be generally of any shape, particularly comprising rounded parts.

We claim:

1. A method of constructing reinforced concrete works, such as tunnels, underground galleries for underground railways, and the like, comprising: excavating an open trench, placing in said trench consecutively and contiguously preframes constituted of prefabricated hollow concrete blocks while leaving joints therebetween, said concrete blocks having walls to be completed with additional concrete up to a desired thickness once said blocks are positioned in said trench, said walls having concrete retaining and reinforcing means for said additional concrete, and means on said walls of each preframe which define said desired thickness and which also define with corresponding means of an adjacent one of said contiguously placed preframes a recess, pouring into said recess said additional concrete to thus cover said joints left between said contiguously placed preframes and form a monolithic work, and filling the remaining space of the trench with a filling material.

2. A method according to claim 1, which comprises using a preframe having an upstream and a downstream end, said preframe having a wall with bottom, side and upper portions, said wall being provided with a concrete reinforcing rib integrally made therewith at least on said side and upper portions, said rib extending from said wall towards the exterior of said preframe substantially at equal distances from said upstream and downstream ends, and having a top defining the ultimate level of added concrete, whereby the reinforcing ribs of two contiguously placed preframes thus form with the remaining wall portions of each preframe a recess, said additional concrete being poured in said recess to a final thickness corresponding to the thickness of said rib or level of said rib top, thus covering a joint left between said two contiguously placed preframes.

3. A method according to claim 1, wherein before being placed in said trench, each preframe is provided with concrete retaining means in the form of a rough external surface intended to retain said additional concrete and with concrete reinforcing means in the form of outer peripheral reinforcements intended to reinforce said additional concrete.

4. A method according to claim 1, wherein the trench is excavated by digging substantially rectangular trench sections the longest dimension of which extends transversely to the longitudinal axis of the underground work intended.

5. A method according to claim 4, wherein a thixotropic mud is poured into a first newly excavated trench section, a first preframe is immerged into said mud of said trench section, a second trench section is excavated contiguously to said first newly excavated trench section, thixotropic mud is poured into said second trench section, a second preframe is placed into said second new trench section subsequently and contiguously to said first preframe already placed, additional concrete is poured to form with said first and second preframes a monolithic concrete work, the remaining space is filled with a filling material, and the preceding steps are repeated each time a new preframe is placed.

6. A method of constructing underground reinforced concrete works, such as underground galleries, road tunnels, tunnels for underground railways and the like, by placing prefabricated preframes in an excavated trench, said trench having bottom and side walls, said side walls being substantially vertical, said method comprising: excavating a first substantially rectangular trench section the longest dimension of which extends transversely to the longitudinal axis of the underground work intended, filling said first trench section with thixotropic mud, immerging in said first trench section a first preframe, said preframe having prefabricated walls to be completed with added concrete on site, said preframe having an upstream and a downstream end, said preframe having a peripheral reinforcing rib extending substantially at equal distances from said ends, excavating a second substantially rectangular trench section the longest dimension of which extends transversely to the longitudinal axis of the underground work intended, contiguously to said first trench section, filling said second trench section with thixotropic mud, immerging in said second trench section a second preframe in juxtaposition with said first preframe leaving a joint between said preframes, said second preframe having prefabricated walls to be completed with added concrete on site, said second preframe having an upstream and a downstream end, said second preframe having a peripheral reinforcing rib extending substantially at equal distances from said ends, pouring additional concrete in the space defined by the walls of said preframes, the walls of said trench sections and the ribs of said first and second adjacent preframes, thus covering said joint between said preframes, filling the remaining space of the trench with a filling material, and repeating the above steps each time a new preframe is placed.

7. A method according to claim 6, comprising, after excavation of said trench section and filling thereof with thixotropic mud, the steps of:

lowering the respective preframe into said trench section until the same penetrates partly into the thixotropic mud, the respective preframe being closed at both ends with a flexible closure wall;

balancing the instantaneous pressure between said thixotropic mud and said flexible wall by partly filling the preframe with water;

continuing the preframe lowering step down to a fresh depth below the height of the preframe;

balancing again the instantaneous pressure on both sides of said flexible wall by further filling the preframe with water;

continuing said procedure until the preframe is totally filled with water;

lowering the preframe down to the specified level but at a certain horizontal distance from any preframe already placed upstream;

precisely adjusting the newly placed preframe against said already placed preframe.

8. A method according to claim 6, comprising, after placing at least two adjacent preframes immerged in thixotropic mud, the steps of:

placing a vertical coffer-dam downstream of said second installed preframe and against said second preframe, said coffer-dam having a height extending from the bottom of said trench section to above the level of said thixotropic mud;

partly filling the space left between said coffer-dam and the downstream wall of the ground with gravel immerged in said thixotropic mud, said gravel exerting a thrust on said coffer-dam and on said second-installed preframe, thus applying said second preframe against said first preframe;

forming foundation piles between said reinforcing forcing ribs of said preframe side walls and the ground;

pouring concrete or a similar filling material under said preframes;

after hardening of said last-mentioned material, casting concrete into the spaces, defined by the outer vertical walls, said reinforcing ribs of said two adjacent preframes and said trench walls;

further casting concrete to cover the upper walls of said two adjacent preframes, between said reinforcing ribs;

placing a second auxiliary coffer-dam in contact with the top of said reinforcing rib of said first preframe;

filling said trench section upstream of said second coffer-dam;

whenever filling a trench section upstream of an auxiliary coffer-dam placed on top of a reinforcing rib, simultaneously removing the corresponding auxiliary coffer dam of the penultimate preframe previously placed;

repeating the cycle of operations by excavating the next transverse trench section in the shelter of the first-mentioned downstream coffer-dam.

* * * * *